United States Patent [19]

Howard et al.

[11] 4,277,189

[45] Jul. 7, 1981

[54] BIDIRECTIONAL CARRIAGE DRIVE EMPLOYING A CLOSED LOOP BELT DRIVE MEANS FOR PRINTERS AND THE LIKE

[75] Inventors: Robert Howard, Windham; Prentice Robinson; Alexander F. Vitale, both of Pelham, all of N.H.

[73] Assignee: Centronics Data Computer Corp., Hudson, N.H.

[21] Appl. No.: 28,318

[22] Filed: Apr. 9, 1979

Related U.S. Application Data

[63] Continuation of Ser. No. 692,484, Jun. 3, 1976, abandoned.

[51] Int. Cl.[3] ..... B41J 19/00

[52] U.S. Cl. ..... 400/320; 400/55; 400/124; 400/322; 400/323; 400/328; 74/37; 346/139 B

[58] Field of Search ..... 400/55, 56, 124, 320, 400/322, 323, 328; 74/37, 230.01; 346/139 R, 139 A, 139 B

[56] References Cited

U.S. PATENT DOCUMENTS

| | | | |
|---|---|---|---|
| 1,469,470 | 10/1923 | Wright | 74/37 X |
| 1,582,107 | 4/1926 | Whiteside | 74/37 UX |
| 1,689,849 | 10/1928 | Aspinwall | 74/37 X |
| 1,706,562 | 3/1929 | Dake | 74/230.01 X |
| 1,774,356 | 8/1930 | Cloud | 74/37 |
| 2,490,035 | 12/1949 | Deakin | 74/37 |
| 2,510,084 | 6/1950 | Deakin | 74/37 |
| 2,520,131 | 8/1950 | Deakin | 74/37 |
| 2,847,859 | 8/1958 | Lynott | 346/139 B UX |
| 2,939,321 | 6/1960 | Shovic | 74/37 X |
| 3,303,513 | 2/1967 | Woods et al. | 74/37 X |
| 3,330,460 | 7/1967 | Wick | 74/230.01 X |
| 3,400,594 | 9/1968 | Steyh | 74/37 |
| 3,472,352 | 10/1969 | Kondur | 400/320 X |
| 3,489,020 | 1/1970 | Angst | 74/37 |
| 3,750,792 | 8/1973 | Liles | 400/124 |
| 3,795,766 | 3/1974 | Farlow | 346/139 B X |
| 3,904,010 | 9/1975 | Krauss et al. | 400/56 |
| 3,935,936 | 2/1976 | Wilczewski | 400/55 |
| 3,945,022 | 3/1976 | Distler | 400/322 X |
| 3,960,256 | 6/1976 | Bickoff et al. | 400/124 |
| 3,981,235 | 9/1976 | Thomas et al. | 400/56 X |

FOREIGN PATENT DOCUMENTS

| | | | |
|---|---|---|---|
| 554389 | 2/1977 | Belgium | 74/37 |
| 1170155 | 5/1964 | Fed. Rep. of Germany | 346/139 B |
| 1911226 | 9/1970 | Fed. Rep. of Germany | 400/322 |
| 2039199 | 2/1972 | Fed. Rep. of Germany | 400/320 |

*Primary Examiner*—Ernest T. Wright, Jr.
*Attorney, Agent, or Firm*—Weinstein & Sutton

[57] ABSTRACT

A drive assembly for printer carriages and the like comprised of a closed looped metallic tape entrained about a drive and a driven pulley and being moved at a substantially constant rate. The carriage assembly reciprocally slides along guide rods for linear movement in a forward and reverse direction and is provided with guideways for enabling substantially unimpeded movement of the upper and lower runs respectively of said closed looped tape. Solenoid operated jam cleat assemblies are respectively engageable with the upper and lower runs of said closed looped tape in a mutually exclusive fashion. Connecting rod means is provided to assure engagement of only one of the jam cleats with the associated run of the closed loop tape to prevent stopping or jamming of the tape and to assist in the release of the deactivated jam cleat. By selective energization of the pair of solenoid assemblies, the carriage assembly may be moved in either the forward or reverse direction at any given instant of time.

A dot matrix print head may be mounted upon the reciprocating carriage assembly which by appropriate utilization of printer electronics, may be utilized for either unidirectional or bidirectional printer systems.

18 Claims, 9 Drawing Figures

BIDIRECTIONAL CARRIAGE DRIVE EMPLOYING A CLOSED LOOP BELT DRIVE MEANS FOR PRINTERS AND THE LIKE

This is a continuation of application Ser. No. 692,484, filed June 3, 1976, now abandoned.

BACKGROUND OF THE INVENTION

Serial printers are in widespread use in applications such as output devices for computers, computer terminals and communications links, to name just a few. Serial printers operate to form either characters or parts of characters printed in a serial or linear fashion. One typical line printer of the serial type is disclosed, for example, in U.S. Pat. No. 3,703,949 which discloses both unidirectional and bidirectional printers.

In line printers of the unidirectional type, the print head carriage is typically positioned initially at the left hand margin of the paper document and is moved in what is commonly referred to as the "forward" print direction, sequentially forming vertically aligned dot patterns, "N" such patterns each cooperatively defining a character, numeral or other symbol. Once a line or a portion of a line is printed, line feed and carriage return operations are normally performed wherein the carriage is returned by movement in the "reverse" direction back to the left-hand margin and by advancing the paper document through a distance at least equivalent to single line spacing.

As shown, for example in U.S. Pat. No. 3,703,949 issued Nov. 28, 1972, a registration technique is employed wherein the moving carriage is provided with a light source and photo-detecting element, which elements are positioned on opposite sides of a stationary registration strip typically formed of a transparent material having an opaque mask or pattern to define a plurality of substantially uniformly spaced narrow transparent slits, whereby the movement of the carriage along the print direction causes the light to strike the photocell as the photocell and light source pass each transparent slit to develop what is commonly referred to as a "video" pulse which is utilized to enable the print wire solenoid drive assemblies only at the instant at which the print wire tips are passing a print position thereby precisely aligning each of the vertically aligned dot patterns commensurate with the pattern of the registration strip. Alternatively, the "video" pulses may be generated by a gated oscillator as described in copending application Ser. No. 703,623, filed July 8, 1976 in the name of Prentice Robinson et al.

In order to be assured that the vertically aligned dot patterns are precisely uniformly spaced along the print line, it is preferable to move the carriage assembly at a constant velocity. Numerous techniques to obtain movement at a constant velocity have provided accompanying disadvantages among which are significant increases in both cost and complexity.

BRIEF DESCRIPTION OF THE INVENTION

The present invention is characterized by providing a novel bidirectional carriage drive assembly which substantially instantaneously accelerates a motionless (or moving) carriage to constant print velocity while eliminating the electromagnetic clutches, brakes or other similar structures required in conventional bidirectional drive systems.

The present invention is comprised of a closed loop flat metallic belt entrained about a pair of pulleys arranged a spaced distance apart, which distance is at least equal to the width of a line of print to be formed on a paper document.

One of said pulleys is arranged as an idler pulley, while the other pulley is preferably driven by a constant speed motor whose output shaft is directly connected to the drive pulley. A soft rubber-tired drive pulley is employed to enhance the traction of the metallic belt. Resilient adjustable means is provided to maintain the closed loop belt under suitable tension.

A carriage assembly is mounted so as to be reciprocally guided along a pair of guide rods and is further provided with a pair of substantially spaced parallel slits or guideways arranged to permit substantially unimpeded passage of the respective upper and lower runs of said closed loop tape.

A pair of pivotally mounted jam cleats are adapted to selectively "jam" the associated run of said closed loop tape against one surface of the elongated slot associated with the jam cleat so as to "lock" the carriage to the closed loop tape.

Each jam cleat assembly is provided with selectively energizable solenoid means for respectively moving its associated jam cleat assembly either into or out of engagement with the closed loop tape means.

A common connector bar is mechanically linked between said first and second jam cleat assemblies so as to move one of the jam cleat assemblies into the disengaged position while the other jam cleat assembly engages an associated run of the closed loop tape thereby assuring that the jamming of each jam cleat assembly against the associated run of the closed loop tape occurs in a mutually exclusive fashion.

In another alternative embodiment, a magnetic member is utilized to form the function of mutual exclusivity of operation of said jam cleat assemblies.

The use of the arrangements described herein provide for bidirectional movement of carriage assemblies which, although certainly usable in line printers of the unidirectional type, is also extremely advantageous for use in line printers of the bidirectional type.

Cam means are provided on the carriage assembly for simply and yet preferably adjusting the gap between the printer platen and the print head mounted upon the carriage assembly.

It is therefore one object of the present invention to provide a novel bidirectional drive for carriage assemblies, especially advantageous for use in line printers.

Still another object of the present invention is to provide a drive means of the type described hereinabove and being comprised of a closed loop constantly driven tape member and a carriage assembly slidably positioned there between and having assemblies mutually exclusively engageable with associated upper and lower runs of said tape to thereby rapidly accelerate and move the carriage assembly at a speed equal to that of the tape and in a direction determined by the portion of the run of the tape engaged by selectively engageable means.

Another object of the invention is to provide a novel means for simply and rapidly adjusting the carriage assembly and print head relative to the printer platen.

DESCRIPTION OF THE FIGURES

The above as well as other objects of the invention will become apparent when reading the accompanying description and drawing in which.

DETAILED DESCRIPTION OF THE INVENTION

Figure 1A:
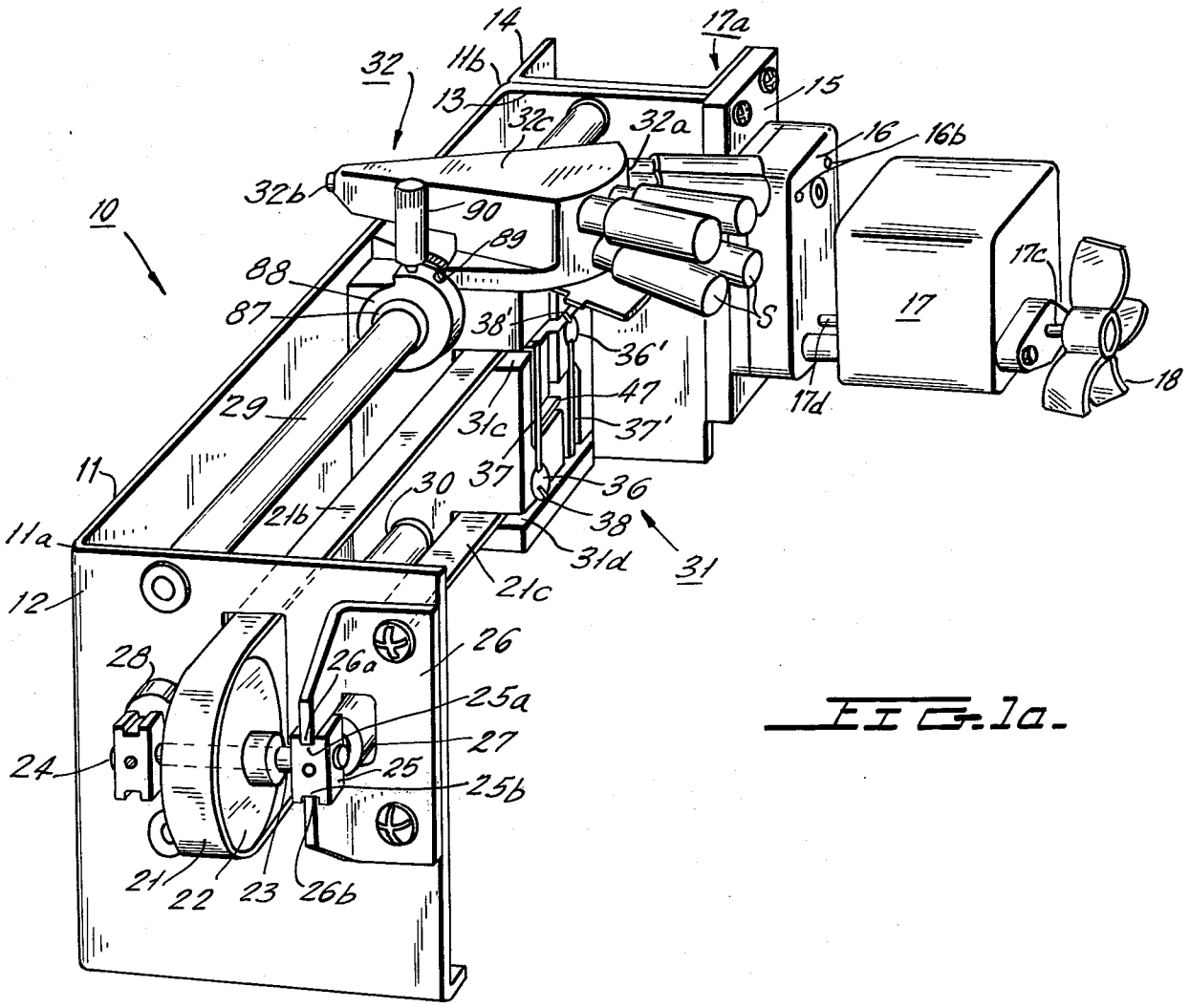
FIGS. 1*a*, 1*b* and 1*c* are left-hand, front and right-hand perspective views respectively of a carriage assembly designed in accordance with the principles of the present invention.
Figure 1B:
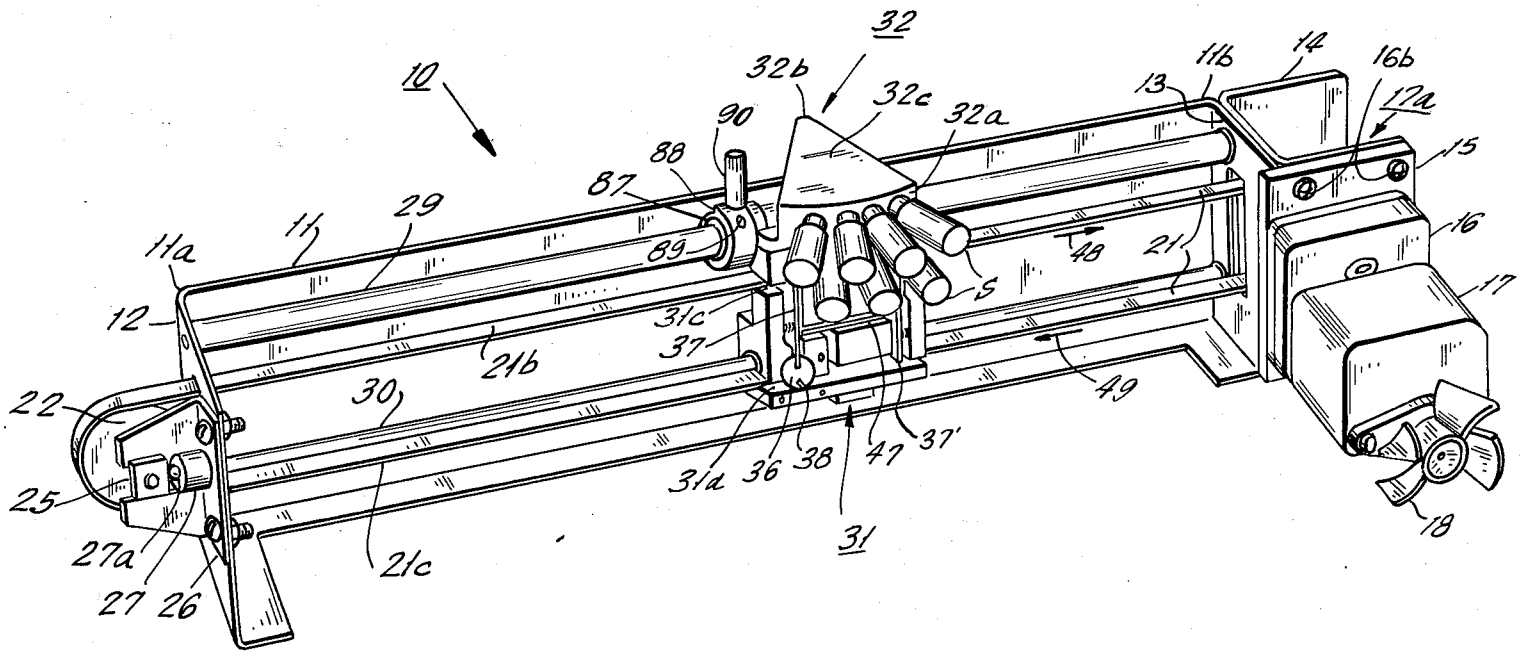
Figure 1D:
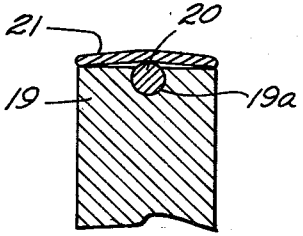
FIG. 1*d* shows a sectional view of the drive pulley of FIG. 1*c*.
Figure 1C:
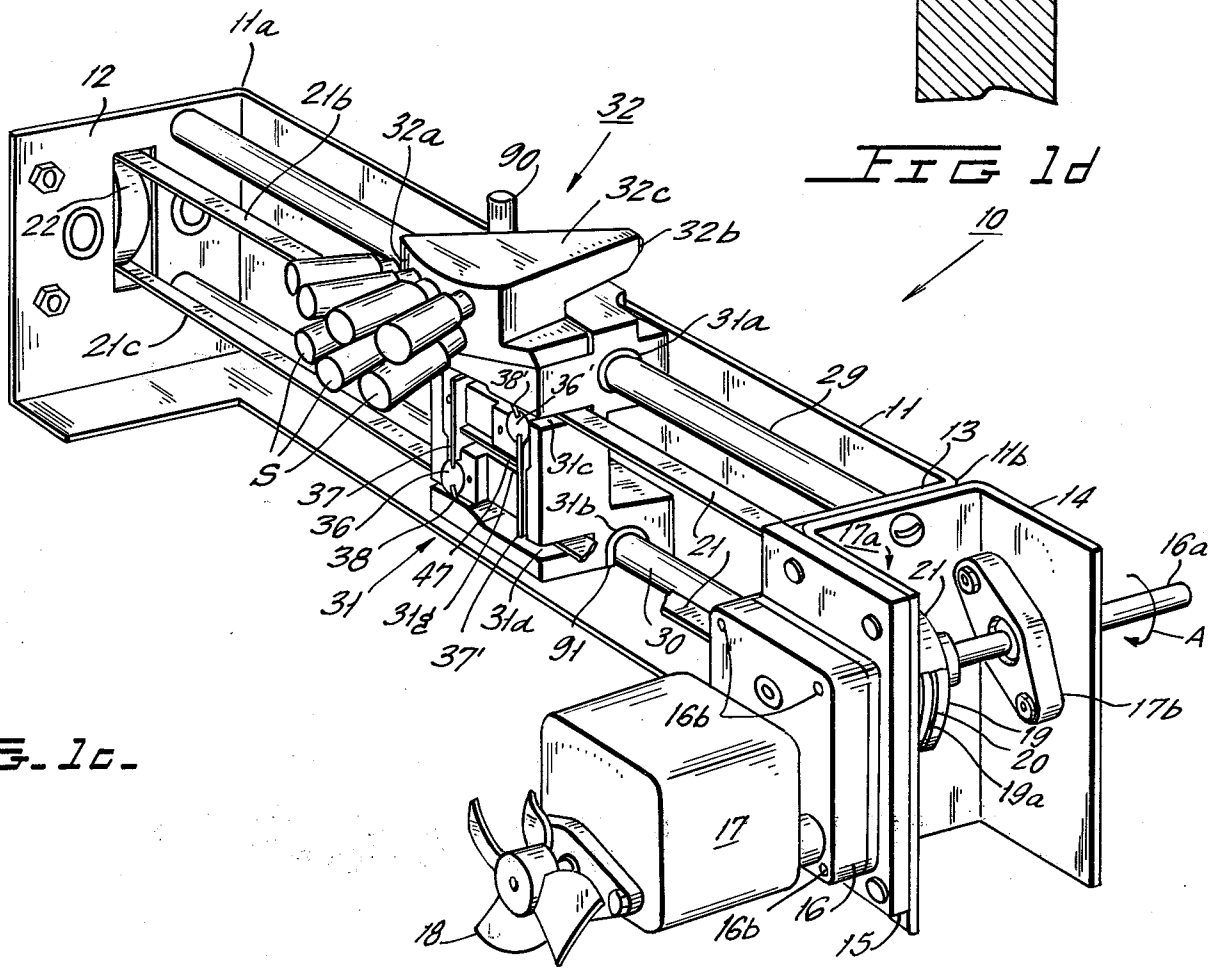

Considering FIGS. 1*a*–1*c*, there is shown therein only those portions of a printer 10 which are considered to be sufficient for purposes of satisfactorily explaining the present invention.

The structure is shown as being comprised of a channel having a substantially vertically aligned spanning frame member 11 bent at 11*a* to form a left side frame member 12 and bent at 11*b* to form a right-side frame member 13 secured to its right-hand end. A substantially U-shaped bracket 14 is securely fastened to side frame member 13 and further has secured thereto a mounting plate 15 which supports a speed reducing assembly 16 which is coupled with motor 17, said assembly 16 being bolted to plate 15 by fastening means 16*b*. The forward end of the motor shaft 17*c* is provided with a small light-weight fan blade assembly 18 utilized for cooling portions of a printer which typically generate heat during operation, such as the printer electronics, not shown for purposes of simplicity, and the motor 17 during operation. The output shaft 17*d* of motor 17 extends into the case of the speed reducing assembly 16 which is provided with its own output shaft 16*a* journalled within a pair of bearings 17*a* and 17*b* secured to the opposite interior walls of U-shaped support bracket 14. Bearing 17*a* is concealed behind bracket 14 but is substantially identical to bearing 17*b*. Also mounted upon the shaft 16*a* so as to rotate therewith is a metal pulley 19 having a crowned peripheral surface and further provided with a continuous annular groove 19*a* for receiving the resilient O-ring 20 provided to assure positive drive between drive pulley 19 and the closed loop metallic, tape-like belt 21, a portion of which has been broken away in FIG. 1*c* to expose groove 19*a* and O-ring 20. See FIGS. 1*c* and 1*d*.

Belt 21 is entrained about pulley 19 at one end thereof and is entrained at the other end threof about a crowned idler pulley 22 which is mounted for free-wheeling rotation about a shaft 23 whose opposite ends are journalled within bearings 24 and 25. Belt 21 has an upper run 21*b* and a lower run 21*c*. Both bearings 24 and 25 have frames of a substantially rectangular shaped configuration and each are provided with grooves along their upper and lower edges. Note, for example, the frame for bearing 25 provided with upper groove 25*a* and lower groove 25*b* respectively adapted to make slidable engagement with the parallel marginal portions 26*a* and 26*b* of an L-shaped bracket 26, which portions 26*a* and 26*b* define a slot for slidably receiving the bearing 25.

A spring loaded ball plunger assembly 27 is mounted on frame member 12 and is provided with an adjustable spring means (not shown) for moving the ball 27*a* in or out so as to provide proper tensioning for belt 21 and proper alignment therefor. Pulley 22 is preferably crowned to assure appropriate alignment of belt 21 thereon. Bearing 24 is also appropriately tensioned by a ball plunger assembly 28 of substantially the same design as the assembly 27. Adjustment of the assemblies 27 and 28 assures parallel alignment of shaft 23 relative to the shaft 16*a* of pulley 19.

The side frame members 12 and 13 have secured thereto elongated upper and lower shafts 29 and 30 respectively, which are arranged in spaced parallel fashion relative to one another and are adapted to slidably support a reciprocating carriage assembly 31.

The carriage assembly 31 is provided with an opening 31*a* and slot or opening 31*b* respectively adapted to slidably receive shafts 29 and 30. Opening 31*a* and slot 31*b* are provided with journalled bearings (not shown) which slide upon the guide bars or shafts 29, 30 during horizontal motion of the carriage assembly 31. Upper opening 31*a* surrounds shaft 29 while lower opening 31*b* is a substantially U-shaped inverted groove cut into the bottom surface 31K of the carriage assembly 31.

Figure 2:
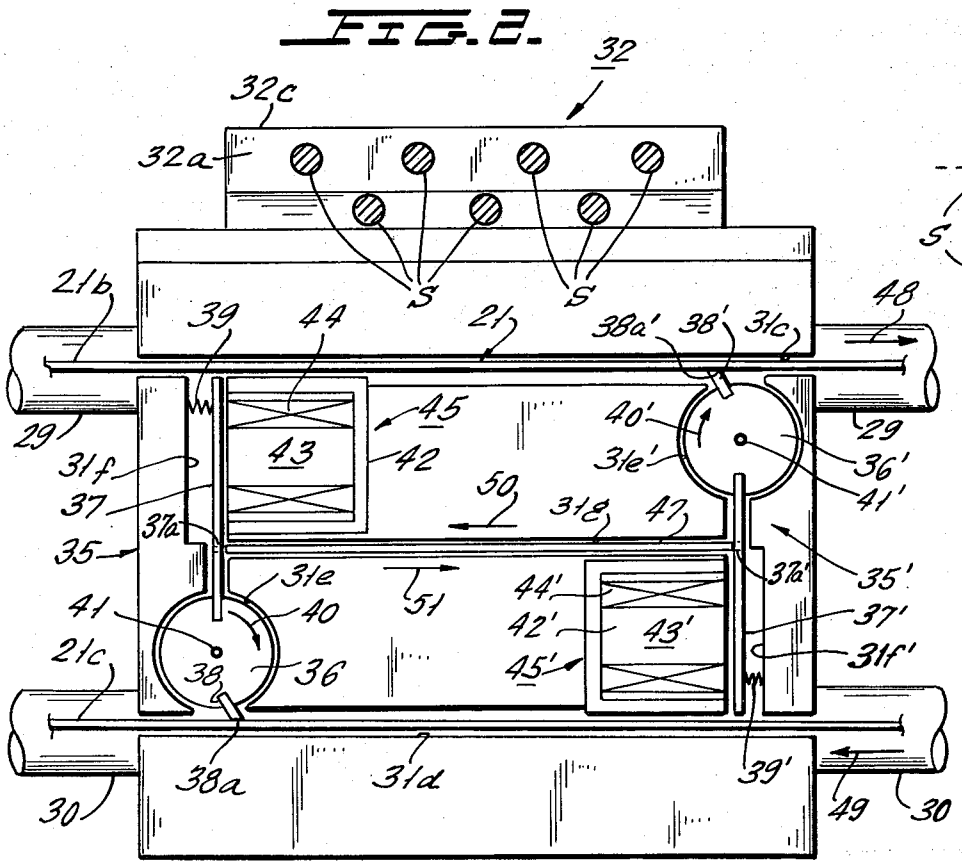
FIG. 2 is a simplified front view of the carriage assembly useful in explaining the manner of operation wherein the view of FIG. 2 shows the carriage assembly looking in the direction of arrows 2—2 of FIG. 4.
Figure 3A:
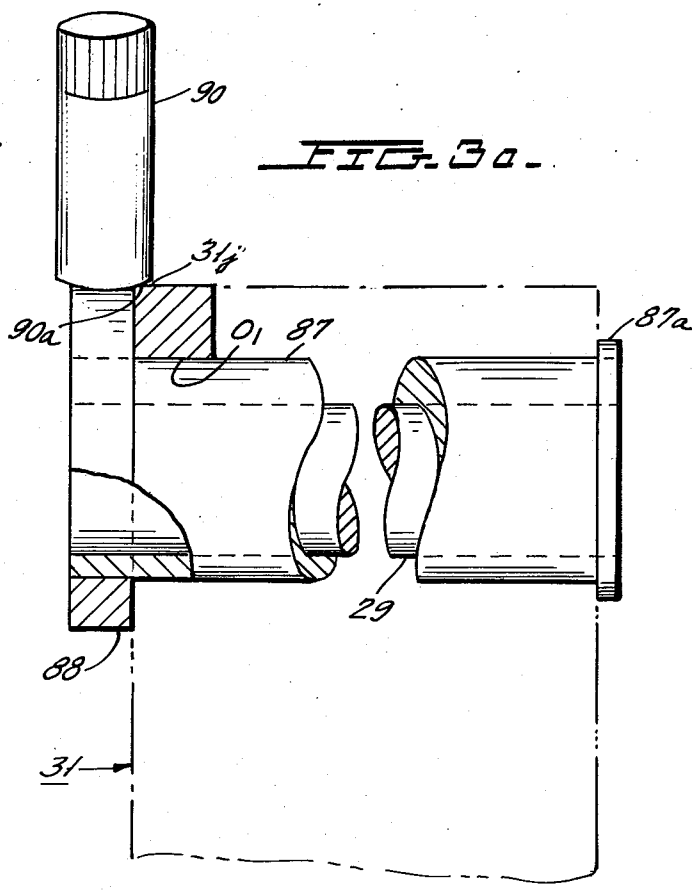
FIGS. 3 and 3*a* show a side and front elevational views of the print head adjustment cam provided in the carriage assembly of FIGS. 1*a*–1*c*.
Figure 3:
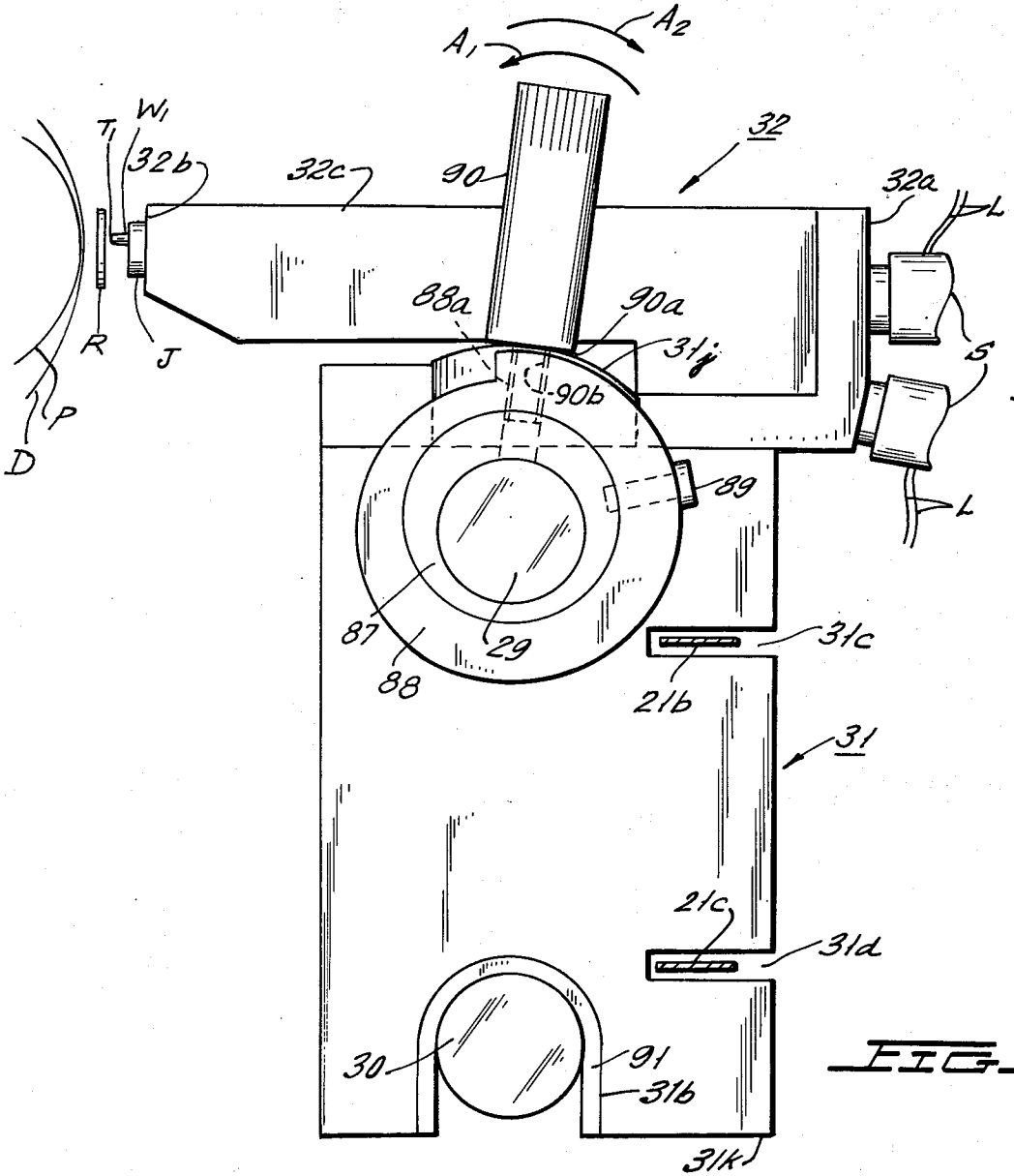

Mounted upon the upper surface of carriage assembly 31 is a print head assembly 32 having a substantially curved rear surface 32*a* adapted to receive and threadedly engage a plurality of solenoids S utilized as the means for driving print wires, one such $W_1$ being shown in FIG. 3, which wires extend from the forward ends of the solenoids S and through the hollow housing of the print head assembly 32 whereby the forward tips, such as tip $T_1$ extend through the nose 32*b* of the print head housing and typically through a jewel bearing J for selectively impacting a print ribbon R so as to form dot patterns, as shown in FIG. 2 of U.S. Pat. No. 3,703,949, upon a paper document D appropriately positioned against the platen P (FIG. 3) which is rotatable to perform line feed and paper slewing operations, for example. The print head assembly 32 is hollow and is provided with a cover member 32*c* for maintaining the print wires within the housing free of dust, dirt or other harmful contaminants.

The solenoids S are each provided with a pair of leads L as shown in FIG. 3, adapted to be connected to power drive circuits which, in turn, are selectively energized to form the vertical dot patterns, five adjacent vertical dot patterns each of a 7-dot height typically being utilized to represent a numeric or alphabetic character, punctuation mark or other symbol as is conventional in printers of the dot matrix type for example, as shown in U.S. Pat. No. 3,703,949.

The carriage assembly 31 is further provided with a pair of substantially horizontally aligned slots 31*c* and 31*d* which serve as upper and lower guideways respectively for the upper and lower runs 21*b* and 21*c* of drive belt 21.

Turning to a consideration of FIG. 2, the carriage assembly 31 can be seen to be comprised of first and second substantially cylindrical shaped openings 31*e* and 31*e* each being adapted to receive and swingably support a drum or cylindrical shaped member 36,36' which, together with a flat arm 37,37' and a wedge 38,38' form jam cleat assembly 35,35'. Each wedge 38,38' is provided with a wedge engaging surface 38*a*,38*a*'. The bottom portion of the substantially circular opening 31*e* communicates with the horizontal guideway 31*d*. A vertically aligned clearance slot 31*f* is adapted to provide sufficient space for arm 37 to swing between a locked and an unlocked position. A spring member 39 is positioned between the left-hand wall of slot 31*f* and the confronting surface of arm 37 so as to normally urge arm 37 and the jam cleat assembly 35 in the clockwise direction shown by arrow 40 about the rotational axis 41. In this manner, arm 37 swings to the right causing the engaging surface 38*a* of the wedge 38 to be displaced slightly above the confronting surface of the lower run 21*c* of belt 21.

Secured within the carriage assembly 31 is a U-shaped magnetic member 42 having a central magnetic core 43 secured to the yoke thereof and having wound therearound a coil 44. The magnetic path for the carriage solenoid 45 extends through core 43 as well as the arms of U-shaped member 42 so as to provide a magnetic attraction to jam cleat arm 37 when the solenoid coil 44 is energized, arm 37 serving as an armature. Energization of the solenoid coil 44 operates to urge arm 37 in the same direction as the biasing force exerted upon arm 37 by spring member 39.

In a substantially mirror image (and inverted) fashion, slot 31*e*' receives cylindrical member 36' which, together with arm 37' and wedge 38' forms a jam cleat assembly 35'. The slot 31*f*' provides sufficient clearance for enabling arm 37' to swing and biasing spring 39' serves to normally urge arm 37' and drum 36' in the clockwise direction as shown by arrow 40' about the rotational axis 41'.

The carriage solenoid 45' is similarly comprised of a U-shaped magnetic member 42', core 43' and winding 44' to serve to magnetically attract arm (i.e. armature) 37' when solenoid 45' is energized in order to exert a force upon arm 37' and to pull it in the same direction as the biasing force exerted by spring 39' upon arm 37'.

Another horizontal guideway 31*g* is provided in the carriage housing and is adapted to receive an interconnecting bar 47 which has its left-hand end extending into an opening 37*a* in arm 37 and has its right-hand end extending into an opening 37*a*' in arm 37'. Springs 39 and 39' prevent the ends of the bar 47 from being released from arms 37 and 37'. A cover plate $C_p$ fits over the front face of the assembly 31 of FIG. 2 to retain all of the elements in position.

The operation of the carriage assembly 31 and drive means therefor is as follows:

Let it be assumed from a consideration of FIGS. 1*b* and 1*c*, for example, that the motor 17 operates the speed reducing assembly 16 so that its output shaft 16*a* rotates in the direction shown by arrow A. Thus, the upper run 21*b* of belt 21 moves in a direction shown by arrow 48 while the lower run 21*c* moves in a direction shown by arrow 49. Assuming both solenoids 45 and 45' to be de-energized, the springs 39 and 39' preferably exert equal biasing forces upon their arms 37 and 37' respectively so that the net forces exerted thereon is substantially nullified and the arms 37 and 37' will assume a "middle" position where they are substantially vertically aligned.

Let it be assumed that it is now desired to drive the carriage assembly 31 in a direction shown by arrow 49. This is accomplished by energizing solenoid 45 causing arm 37 to be drawn toward the solenoid 45, rotating the jam cleat assembly 35 in the clockwise direction shown by arrow 40. This moves wedge member 38 into wedging engagement with the confronting surface of the lower run 21*c* of belt 21. The clockwise swinging movement experienced by arm 37 moves inter-connecting arm 47 in the direction shown by arrow 51 imparting a counterclockwise swinging movement to arm 37' of jam cleat assembly 35' thereby disengaging the surface 38*a*' of wedge member 38 from the confronting surface of the belt upper run 21*b* thereby moving the carriage assembly 31 in a direction shown by arrow 49.

Similarly when it is desired to move the carriage assembly 31 in the reverse direction shown by arrow 48, the solenoid 45 is energized causing arm 37' to swing in the clockwise direction shown by arrow 40' and thereby engaging wedge member 38' with the confronting surface of upper belt run 21*b*. This swinging movement is imparted to inter-connecting rod 47 to move the rod 47 in the direction shown by arrow 50 thereby swinging arm 37 of jam cleat assembly 35 in the counter-clockwise direction causing its wedge 38 to be disengaged from the confronting surface of the belt lower run 21*c* thereby driving the carriage assembly 31 toward the right.

The motor 17 is preferably a gear motor adapted to cause its output shaft 17*c* to rotate at a constant rpm hence moving the belt 21 at a constant velocity. By appropriate energization of the carriage operating solenoids 45 and 45' it is possible to abruptly accelerate the carriage assembly 31 up to the speed of belt 21 in a very rapid fashion so as to maintain constant movement of the carriage assembly 31 and hence the print head assembly 32 during printing thereby assuring very precise registration of the dot patterns.

The carriage assembly 31 described hereinabove may be utilized for either unidirectional or bidirectional printers wherein movement of the carriage assembly 31 in the direction shown by arrow 49 of FIG. 2 may constitute a carriage return operation for unidirectional printers or alternatively may be utilized to provide for right-to-left printing in bidirection printers, for example, of the type described in U.S. Pat. No. 3,858,703 issued Jan. 7, 1975 and assigned to the assignee of the present application.

When either of the solenoids 45 or 45' is energized, the interconnecting bar 47 simultaneously serves the dual functions of causing one of the wedge members 38 or 38' to wedge the associated run 21*c* or 21*b* of the belt 21 between the wedge member 38 or 38' and the opposite side of the guidway 31*d* or 31*c* through which the run 21*c* or 21*b* extends and further causes the remaining wedge 38' or 38 to be displaced from the opposite run 21*b* or 21*c* of the belt 21. In the event that both solenoids 45 and 45' were erroneously energized, the interconnecting bar 47 would either cause a neutral condition to occur whereby neither wedge 38 or 38' would be urged against the belt 21, or alternatively, in the event that there was any even slight imbalance in the pulling force of the solenoids 45 or 45', the interconnecting bar 47 would permit only one of the solenoids 45 or 45' to pull in one of the jam cleat assemblies 35 or 35'. This is also true in the case where neither solenoid 45 or 45' is energized so that if perfect balance exists between the biasing springs 39 and 39', both wedges 38 and 38' will be displaced from their associated runs 21c or 21b of the belt 21 or, in the event that there is a slight unbalance in the biasing forces, the carriage assembly 31 will be caused to move in only one direction due to the presence of the interconnecting bar 47. It may, for example, be desirable to provide an unbalanced condition between the springs 39 and 39' which normally causes the wedge member 38 which controls return movement to be urged against the belt 21 in order to assure that the carriage assembly 31 will be returned to the left hand margin in readiness for a subsequent printing operation (which may be the preferred case for unidirectional printers). Preferably, however, the biasing forces of springs 39 and 39' are sufficiently light to prevent either wedge 38 or 38' from gripping the belt 21.

Figure 4:
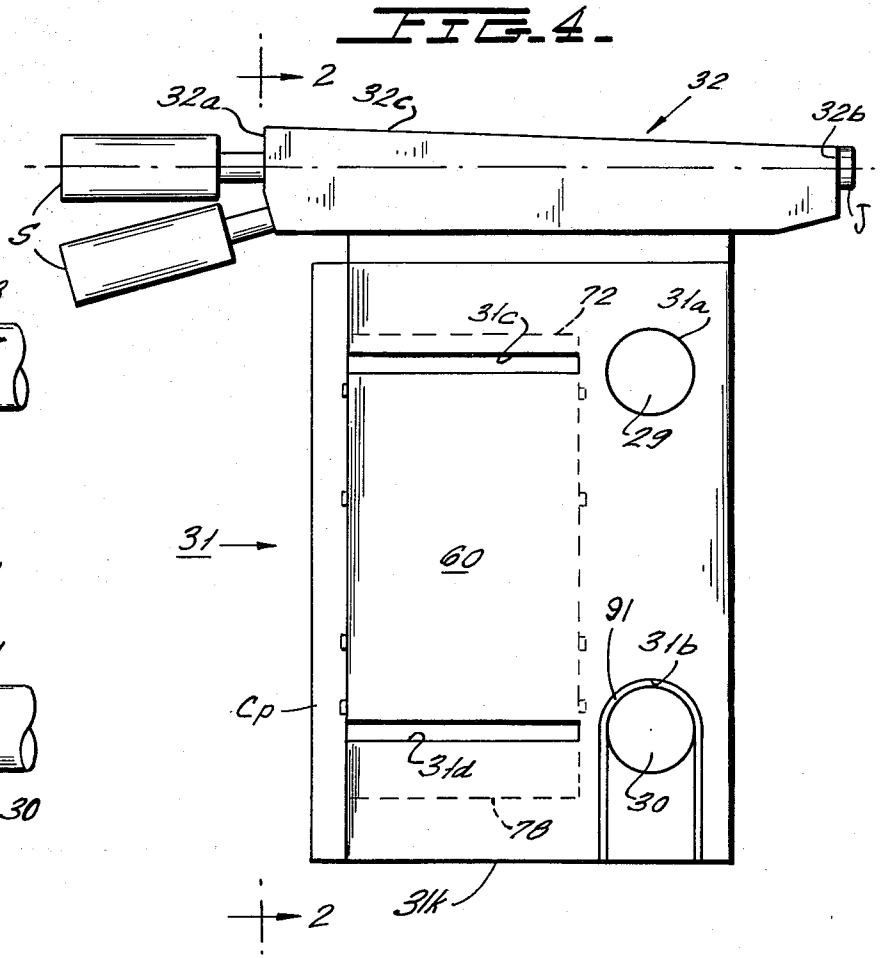
FIG. 4 shows an elevational view of another preferred embodiment of the invention.
Figure 4A:
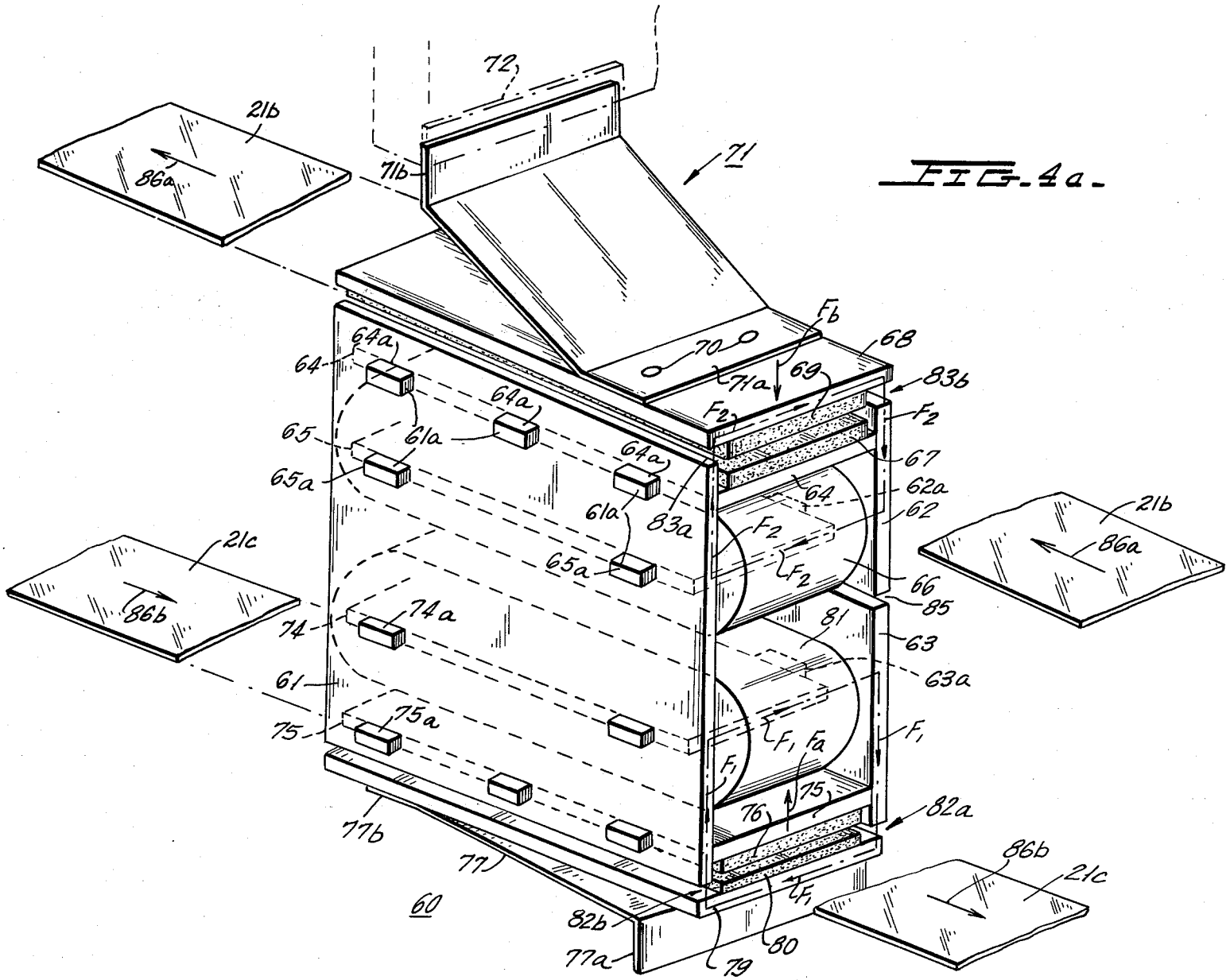
FIG. 4*a* is a perspective view showing the magnetic control assembly of the preferred embodiment of FIG. 4.

FIG. 4 shows an alternative embodiment 60 of the present invention from a side elevational view thereof while FIG. 4a shows the detailed arrangement of the latching device 60 in perspective. As shown in FIG. 4, the carriage assembly 31 is provided with print head assembly 32 and has opening 31a and inverted U-shaped slot 31b for slidably receiving top and bottom guide shafts 29 and 30 respectively. Passageways or slots 31c and 31d are provided for the passage of the upper and lower runs 21b and 21c of belt 21. Turning to a consideration of FIG. 4a, the assembly 60 can be seen to be comprised of vertically aligned side plate 61 and a pair of co-planar vertically aligned plates 62 and 63 which are arranged in spaced parallel fashion relative to plate 61. A first pair of spacer plates 64 and 65 are arranged in horizontally aligned, spaced parallel fashion relative to one another and opposing longitudinal sides are provided with projections 64a and 65a respectively, which extend through elongated slots 61a provided in side plate 61. Similar projections are provided along the opposite sides of plates 64 and 65 to cooperate with similarly aligned elongated slots in plate 62 such as slot 62a.

The solenoid coil 66 is wound about magnetic plate 65 in the manner shown. A flat planar rectangular-shaped friction pad 67 is provided along the top surface of spacer plate 64. A plate 68 is positioned immediately above the upper edges of plates 61 and 62 and has a similar friction pad 69 secured to its under surface and positioned to confront the top surface of friction pad 67. Plate 68 is secured by suitable fastening means 70 to the lower flange 71a of a leaf spring member 71, whose upper flange 71b is inserted with within a vertically aligned slit 72 (note also FIG. 4) in the carriage assembly 31 which contains the latching device 60.

As can be seen from FIG. 4a, the upper run 21b of belt 21 passes between the confronting surfaces of friction pads 67 and 69 and leaf spring 71 is normally adapted to cause the belt 21 to be in slight sliding engagement opposite side of the guidway 31d or 31c through which the run 21c or 21b extends with the pads 67 and 69 as it moves through the slot 31c.

The latching device 60 is further comprised of a pair of lower plates 74 and 75 provided with projections 74a and 75a extending through cooperating slots 61a and 63a in plates 61 and 63 in the manner shown. A solenoid coil or winding 81 is wound about plate 74. The under surface of spacer plate 75 has a friction pad 76 secured thereto and a leaf spring 77 has its lower flange 77a secured within a vertically aligned slot 78 provided in the carriage assembly 31 while its upper flange 77b is secured by suitable fastening means similar to fastening means 70 but not shown for purposes of simplicity, to the under surface of plate 79 whose upper surface has a friction pad 80 secured thereto. The leaf spring 77 is so arranged as to normally maintain friction pads 76 and 80 in slight sliding engagement with the lower run 21c of belt 21. Plates 61, 62, 63, 65 and 74 are comprised of a magnetic material and are preferably ferrite plates. Plates 64 and 75 are non-magnetic and preferably are comprised of a plastic material. Plates 64 and 75 cooperate with plates 65 and 74 to maintain plates 61, 62 and 63 in proper spaced alignment.

The manner of operation of the alternative embodiment of FIG. 4a is as follows:

Let it be assumed that the upper run 21b of the belt 21 is moving in a direction shown by arrow 86a thereby indicating that the lower run 21e moves in the direction shown by arrow 86b. Assuming that it is desired to move the carriage assembly 31 in the direction shown by arrow 86b, solenoid winding 81, which is wound about plate 74, is energized establishing a flux path designated by the lines F1 which can be seen to extend through plate 74, side plate 63, across the air gap 82a, through plate 79, across the opposite air gap 82b and through side plate 61 back to plate 74. This magnetic path causes a force $F_a$ to be exerted upon armature plate 79 pulling the plate 79 upwardly against the biasing force of leaf spring 77 so as to wedge or grip the lower run 21c of the belt 21 between the friction pads 76 and 80 thereby causing the carriage assembly 31 to move in the direction shown by arrow 86b together with the lower run 21c of the belt 21. The continuous but light sliding engagement between the pads 76 and 80 reduces the distance travelled by armature plate 79 to provide substantially instantaneous gripping of the belt 21. The wedging effect developed by spring 77 significantly increases the gripping forces exerted by the pads 76 and 80 upon the belt 21.

In a similar fashion, if it is desired to move the carriage assembly 31 in the direction shown by arrow 86a, solenoid winding or coil 66 is energized to establish a flux path $F_2$ extending through plate 65, side plate 61, air gap 83a, armature plate 68, air gap 83b, side plate 62 and back to plate 65 whereupon a magnetic force $F_b$ is exerted against the biasing force of leaf spring 71 to move friction pad 69 toward pad 67 thereby firmly gripping the upper run 21b of belt 21 there between and causing the carriage assembly 31 to move in a direction shown by arrow 86a.

As will be noted, an air gap 85 is provided between adjacent edges of plates 62 and 63 to serve a function similar to that of interconnecting bar 47 of FIG. 2 which air gap functions in the following manner:

Assuming that both solenoid coils 81 and 66 are simultaneously energized, and, due to the directions in which the solenoid coils 81 and 66 are wound, the flux path will extend through ferrite plate 65, the lower portion of plate 62 and air gap 85, the upper portion of plate 63, ferrite plate 74 and back to ferrite plate 65 through the portion of plate 61 extending between ferrite plates 65 and 74. This is due to the fact that the smallest reluctance path is across air gap 85 (the reluctance across gaps 82a–82b and 83a–83b being of higher reluctance). This arrangement thereby prevents a flux path from forming across the air gaps 83a and 83b and 82a and 82b to prevent both the upper and lower runs 21b and 21c of belt 21 from being simultaneously gripped by the latching device 60 so as to prevent the belt 21 from either being stopped or jammed, to prevent the motor 17 from being overheated or damaged.

The leaf springs 71 and 77 place the friction pads 69 and 80 in continuous light sliding engagement with the belt 21, which is preferably formed of non-magnetic stainless steel or similar material. Energization of the appropriate solenoid coil 66, 81 which pulls the appropriate armature plate 68 or 79 toward its solenoid coil 66 or 81 causing a significant magnification of the force applied against the belt 21 by virtue of the wedging action of the spring 71 or 77. Note, for example, spring 71. When armature plate 68 is pulled downwardly, the spring member 71 through plate 68, is wedged against the belt 21 to significantly magnify the force applied to the belt 21 by the initial energization of the solenoid coil 66. The spring 71 serves the further function of preventing the armature plate 68 from moving in the direction of the belt 21, the spring 71 being fixed at its upper end **71*b* to the carriage assembly 31 by insertion into slot 72. The light pre-loading force applied to armature plate 68 by spring 71 is such that the friction pad 69 is always in light sliding contact with the confronting surface of the upper run 21*b* of the belt 21. Since there is almost no relative motion between the friction pads 68 and 67 when solenoid coil 66 is energized, this greatly minimizes operating time to significantly increase acceleration of the carriage assembly 31** to belt speed.

Spring 77 functions in the same manner as spring 71.

The plates 64 and 75 are preferably formed of a rigid non-conductive material such as, for example, plastic and serve as spaces for maintaining proper spacing between plate 62 and 63 and plates 61 as well as serving as support surfaces for the respective friction pads 67 and 76.

FIG. 3 shows the adjustable mounting for carriage assembly 31 which is comprised of an inverted substantially U-shaped opening **31*b* formed in the bottom surface 31*k* of carriage assembly 31 so as to embrace and slidably engage lower support shaft 30. The surface of groove or opening 31*b* is provided with a suitable lining 91 which acts as a low friction bearing for shaft 30**.

The upper end of the carriage assembly 31 is provided with an opening $O_1$ for receiving the eccentric cam insert 87 having a surrounding cam ring 88 secured thereto by set screw 89. One surface of the cam ring 88 abuts against the left hand surface of carriage assembly 31 as shown in FIG. **1*b***.

A locking adjustment handle 90 is provided with a threaded portion **90*b* which threadedly engages a tapped opening 88*a* in cam ring 88. The cam insert 88 extends through the opening $O_1$ provided in carriage assembly 31 and may, for example, be provided with a flange 87*a* along its right hand edge (see FIG. 3A) so that the flange 87*a* and the cam ring 88 cooperatively function to prevent the cam insert 87 from moving relative to the carriage assembly 31**.

The top surface of carriage assembly 31 adjacent to cam ring 88 is provided with a curved convex portion **31*j* (see FIGS. 3 and 3*a*) which serves to cooperate with a shoulder 90*a* of adjustment handle 90 to lock the cam ring 87 and hence the cam insert 87 into the desired angular position for adjustment of the print head assembly 32** relative to the platen P in a manner to be more fully described.

The front end or nose **32*b* of the print head assembly 32** is thus made adjustable relative to the platen P to compensate for the thickness of the paper document, the number of copies to be made during printing, etc.

By rotating the handle 90 so as to move counterclockwise as shown by arrow $A_1$, the cam ring 88 rotates in the same direction, as does the cam insert 87, being locked to cam ring 88 by set screw 89. Movement in this direction serves not only to move the print head nose **32*b* closer to platen P but, when moving closer, also moves the carriage assembly 31 and the print head assembly 32 from a slightly diagonally aligned position towards the horizontal position. When the appropriate setting between nose 32*b* and platen P is selected, adjustable handle 90 is tightened so that its shoulder 90*a* firmly engages the curved portion 31*j* along the top surface of the carriage assembly 31 and thereby locks the carriage assembly 31 and hence the print head assembly 32** into the appropriate position.

The inverted U-shaped opening **31*b* formed along the underside of carriage assembly 31** serves to permit the carriage assembly to experience some movement in either the upward or downward vertical direction.

Rotation of handle 90 in the reverse or clockwise direction as shown by arrow $A_2$, from the position shown in FIG. 3, causes the nose **32*b* to move away from platen P and thereby increase the spacing therebetween. This movement is accompanied with slight tilting of the carriage assembly 31 and the print head assembly 32 so that the print head assembly 32** tends to "follow" the curvature of the platen P and tends to be substantially maintained in radial alignment with the platen P.

Various changes and modifications can be made in the processes and products of this invention without departing from the spirit and the scope thereof. The various embodiments set forth herein were presented for the purpose of further illustrating the invention and were not intended as limiting. For example, a conventional return spring may be used to automatically reset the carriage to the left-hand margin, eliminating the need for one solenoid, one jam cleat and the interconnecting bar of FIG. 2.

What is claimed is:

1. Driving means for printers and the like comprising:

rotatably mounted drive and idler pulleys;

a closed loop belt entrained about said pulleys and defining first and second belt runs;

means for rotating said drive pulley and said belt;

a carriage assembly and means for slidably guiding said carriage assembly along a path arranged substantially parallel to at least one of said first and second belt runs;

said carriage assembly including first and second guideway passages for receiving said first and second belt runs, respectively;

first movable means pivotally mounted in said carriage assembly and including first wedge means movable into said first guideway passage for engaging and gripping said first belt run, said first wedge means being pivotally mounted to increase the wedging action as said first wedge means pivots, whereby the movement of said first belt run contributes to said wedging action;

second movable means pivotally mounted in said carriage assembly and including second wedge means movable into said second guideway passage for engaging and gripping said second belt run, said second wedge means being pivotally mounted to increase the wedging action as said second wedge means pivots, whereby the movement of said second belt run contributes to said wedging action;

means for normally biasing said first and second movable means to pivot in a direction to simultaneously move both said first and second wedge means away from said first and second guideway passages and out of engagement with said first and second belt runs;

first and second control means for urging said first and second movable means against the force of said biasing means and for moving one of said first and second wedge means in the direction of movement of an associated first and second belt run and into wedging engagement with said associated belt run whereby said carriage assembly is driven in a direction determined by the run of the belt engaged by said first or second wedge means.

2. The driving means of claim 1 wherein said biasing means includes interconnecting means coupled between said first and second movable means for preventing said first and second wedge means from simultaneously engaging their associated belt runs regardless of the operating status of said first and second control means.

3. The apparatus of claim 1 wherein said belt is formed of metal; and means are provided for supporting said idler pulley and maintaining said belt under proper tension.

4. The apparatus of claim 3 wherein said pulleys are crowned to maintain said belt centered on said pulleys.

5. The apparatus of claim 4, wherein the crowned periphery of said drive pulley is provided with a continuous groove; and a resilient O-ring is positioned in said groove and continuously engages the belt for enhancing the frictional drive between said drive pulley and said belt.

6. The apparatus of claim 1 wherein said first and second wedge means are aligned so as to extend diagonally from their respective pivotal axes towards the associated run of said belt, and said first and second movable means include first and second operating means, respectively, arranged substantially perpendicular to the associated run of said belt.

7. The apparatus of claim 1 wherein said first control means includes a first solenoid; said first movable means includes an arm positioned adjacent said first solenoid and being attracted to said first solenoid when energized to move said first wedge means into engagement with said first belt run.

8. The apparatus of claim 1 wherein each of said first and second movable means includes an armature assembly and each of said first and second control means includes solenoid means; each of said armature assemblies being positioned a spaced distance from its associated solenoid means.

9. The apparatus of claim 8 wherein each of said solenoid means includes magnetic members defining a U-shaped flux path and cooperating with their associated armature assemblies to define a closed loop magnetic flux path including air gaps between said U-shaped flux path and said associated armature assembly which extends across and is positioned above said U-shaped flux path.

10. The apparatus of claim 1 wherein said first movable means and said first control means are disposed on the same side of said first belt run.

11. The apparatus of claim 1 wherein said second movable means and said second control means are disposed on the same side of said second belt run.

12. Driving means for printers and the like comprising:

rotatably mounted drive and idler pulleys; a closed loop belt entrained about said pulleys and defining first and second belt runs;

means for rotating said drive pulley;

a carriage assembly and means for slidably guiding said carriage assembly along a path arranged substantially parallel to at least one of said first and second belt runs;

said carriage assembly including first and second guideway passages for respectively receiving each of said first and second belt runs;

first and second armature members respectively positioned adjacent to said first and second guideway passages so that respective runs of the belt are positioned between each of said first and second armature members and each of said first and second guideway passages;

first and second solenoid control means each positioned adjacent a respective run of said belt and on a side opposite an associated armature member;

first and second leaf spring means each having their first ends respectively secured to said carriage assembly and their second ends respectively engaging an associated one of said first and second armature members to urge the armature members into light engagement with said belt;

each leaf spring means being aligned relative to its associated armature member to create a wedging action upon its associated armature member and said belt when its associated armature member is urged towards said belt by energization of its associated solenoid control means whereby the forces exerted upon said armature members by said belt work together with the force of said solenoid control means exerted on said belt to significantly increase the driving force as a result of the alignment and wedging action of the leaf spring means.

13. The apparatus of claim 12 wherein said first and second solenoid control means each include magnetic members defining a U-shaped flux path and cooperating with their associated armature members which comprise a closed loop magnetic flux path including a pair of air gaps between the ends of the magnetic members forming said U-shaped flux path and the adjacent portions of said armature members which comprise a flat member extending across and positioned above said U-shaped flux path.

14. The apparatus of claim 13 further including jam prevention means comprising air gap means arranged between adjacent portions of the magnetic members forming said U-shaped flux paths; the reluctance of said air gap means being less than the reluctance of the air gap between said armature members and their cooperating solenoid control means to divert all of the magnetic flux developed by said solenoid control means through said air gap means.

15. The driving means of claim 12 further comprising means including an air gap arranged between said first and second solenoid control means for reducing the operating flux to said armature members in the event that both solenoid control means are energized at the same time.

16. Driving means for printers and the like comprising:

spaced drive and idler pulleys and a closed loop belt entrained about said pulleys defining first and second belt runs;

means for rotating said drive pulley to move said belt;

first and second guide rods extending parallel to the runs of said belt between said pulleys;

a carriage assembly having first and second guide openings for respectively slidably receiving said first and second guide rods and having first and second guideways for respectively receiving the spaced runs of said belt;

first and second wedge means selectively operable for gripping one of the runs of said belt leaving the opposite run free to move along its guideway when in a first position and for gripping the opposite run of said belt leaving the said one run of said belt free to move within its guideway when said wedge means is operated to a second position thereby slidably moving said carriage assembly along said guide rods;

each of first and second wedge means being pivotally mounted to increase the wedging action as each of said first and second wedge means pivots, whereby the movement of the associated belt run contributes to said wedging action;

means for simultaneously moving both said first and second wedge means away from said respective first and second guideways and out of engagement with the associated belt runs;

cam means having a hollow core and being rotatably mounted upon said carriage assembly to receive and be rotatable about one of said guide rods; and a print head having print means arranged at a print forming end, said print head being mounted upon said carriage assembly; and a platen positioned adjacent the print forming end of the print head whereby manipulation of said cam means serves to adjust the position of the print means relative to said platen; and means for retaining the carriage assembly in an adjusted position.

17. The apparatus of claim 16 wherein said platen is cylindrical and said cam means are constructed to substantially radially align said print head with said platen when said cam means is adjusted.

18. The apparatus of claim 16 wherein said retaining means includes an adjusting handle releasably secured to said cam means and having a shoulder engageable with an adjacent surface portion of said carriage assembly for locking the position of said cam means after adjustment thereof.

* * * * *